United States Patent [19]

Rice et al.

[11] 4,050,625

[45] Sept. 27, 1977

[54] CARTON END CLOSURE AND REINFORCING CONSTRUCTION

[75] Inventors: Clifford Brant Rice, East Windsor; David Paul Mastroianni, Ellington, both of Conn.

[73] Assignee: Rice Packaging Inc., Ellington, Conn.

[21] Appl. No.: 751,466

[22] Filed: Dec. 16, 1976

[51] Int. Cl.[2] ..... B65D 5/06

[52] U.S. Cl. ..... 229/38

[58] Field of Search ..... 229/38, 39

[56] References Cited

U.S. PATENT DOCUMENTS

| | | | |
|---|---|---|---|
| 234,222 | 11/1880 | Arthur | 229/38 |
| 307,897 | 11/1884 | Arthur | 229/38 |
| 436,141 | 9/1890 | Lohmann | 229/38 |
| 436,142 | 9/1890 | Lohmann | 229/38 |
| 462,713 | 11/1891 | Keith | 229/38 |
| 2,995,238 | 8/1961 | Casselman | 229/38 X |

*Primary Examiner*—Davis T. Moorhead

*Attorney, Agent, or Firm*—Kenwood Ross; Chester E. Flavin

[57] ABSTRACT

In a carton of the type wherein a supplemental reinforcing panel is disposed within the carton immediately rearwardly of the front panel, with the supplemental reinforcing panel being hingedly connected to a first bottom dust flap which is hinged to one of the carton side panels, and a second bottom dust flap is hinged to the other of the carton side panels, locking shoulders are provided on the bottom dust panels for engagement with locking slots on the carton bottom panel, thereby providing a double lock for the bottom panel to create a stronger box closure.

2 Claims, 9 Drawing Figures

CARTON END CLOSURE AND REINFORCING CONSTRUCTION

Cartons having a reinforcing interior supplemental panel are used for packing such as nails, screws and the like.

In prior art cartons of the type wherein a reinforcing interior supplemental panel is employed, poor bottom panel locking is prevalent for the reason that the flap connecting the supplemental panel to the carton side panel makes it impossible to obtain any locking along one side of the bottom panel, thus making for a poor carton.

Accordingly, a primary object of the invention is to provide a double locking feature for the bottom panel of a carton having a supplemental reinforcing panel, thereby forming a more square box with both locks engaged to increase strength and durability.

Figure 1:
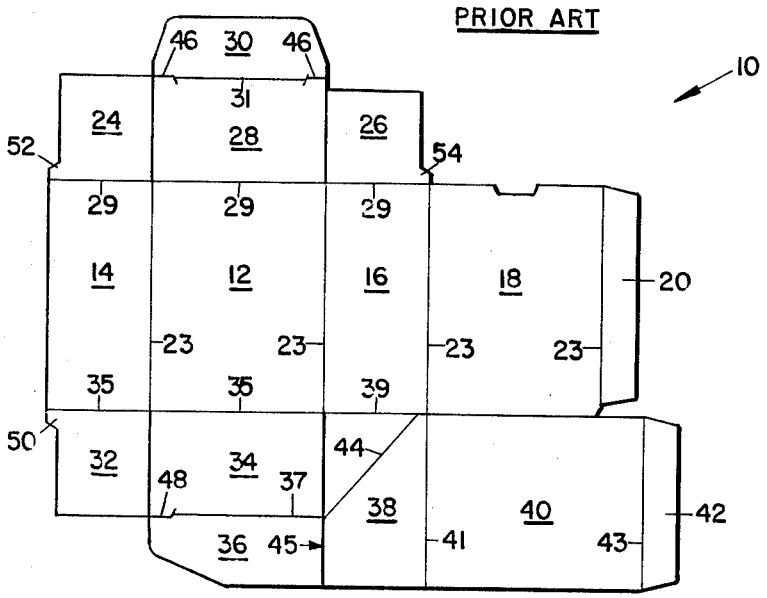
FIG. 1 is a top plan view of a blank for forming a carton of the prior art.
Figure 9:
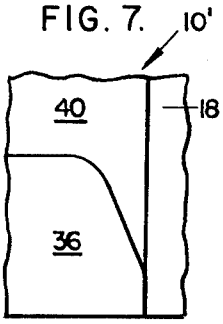
FIG. 9. PRIOR ART
FIG. 9 is a view similar to FIG. 7, but showing the carton of the prior art.
Figure 8:
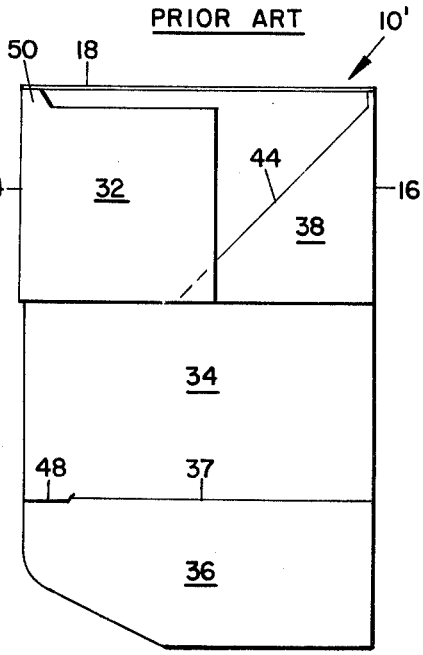
FIG. 8 is a view similar to FIG. 6, but showing the carton of the prior art.

Referring first to FIG. 1, a prior art carton blank 10, when erected, forms the carton 10′ of FIGS. 8 and 9.

Blank 10 includes a rear panel 12 having a first side panel 14 and a second side panel 16 hinged thereto along opposite side edges thereof, the side panel 16 additionally having a front panel 18 hinged thereto.

A glue flap 20 hinged to one edge of front panel 18 and having an adhesive, not shown, on its rear face, is adapted to seal with first side panel 14 on carbon erection.

Spaced, parallel, longitudinal, vertically-extending score lines 23 separate the several panels and glue flap for facilitating carton erection.

A first top dust flap 24 and a second top dust flap 26 are hinged to the upper ends of first and second side panels 14 and 16 respectively, and a top panel 28 is hinged along one edge to the upper end of rear panel 12 along aligned, horizontal, transversely extending score lines 29, the top panel having a tuck flap 30 hinged to its opposite edge along a horizontal transversely-extending score line 31, disposed in spaced parallelism to score lines 29.

A first bottom dust flap 32 is hinged to the lower end of first side panel 14 and a bottom panel 34 is hinged along one edge to the lower end of rear panel 12 along aligned, horizontal transversely-extending score lines 35, the bottom panel having a tuck flap 36 hinged to its opposite edge along a transversely-extending score line 37, score line 37 being disposed in spaced parallelism to score lines 35.

A second bottom dust flap 38 is hinged to the lower end of second side panel 16 along a horizontal, transversely-extending score line 39 which is aligned with the score lines 35 and disposed in spaced parallelism to score line 29.

A supplemental reinforcing panel 40 is hinged at one of its edges 4 to a side edge of second bottom dust flap 38 along a vertical, longitudinally-extending score line 41 which is aligned with the score line 23 separating front panel 18 and second side panel 16.

A dust flap 42 is hinged to the opposite edge of supplemental reinforcing panel 40 along a vertical, longitudinally-extending score line 43 disposed in spaced parallelism to score line 41.

A score line 44 is provided in second bottom end flap 38 and extends diagonally from score line 39 to a vertical edge 45 of the second bottom dust flap disposed adjacent bottom panel 34 and tuck flap 36.

A pair of spaced horizontally-disposed locking slots 46, 46 are provided at the opposite ends of the score line 31 which separates top panel 28 and its tuck flap 30, the score line being disposed approximately 1/32 inch downwardly from the slots 46. A single horizontally-disposed locking slot 48 is provided at one end of the score line 37 approximately 1/32 inch upwardly of the score line 37 which separates bottom panel 34 and its tuck flap 36, the locking slot 48 being disposed at that end of the score line which is adjacent first bottom dust flap 32.

To erect the carton 10′ from blank 10, side panels 14 and 16 are bent upwardly relative to rear panel 12, front panel 18 is bent forwardly over the raised side panels and the rear face of glue flap 20 is adhered to the inner face of side panel 14.

Supplemental reinforcing panel 40 is now brought to a position wherein it is disposed immediately rearwardly of front panel 18, this being accomplished by bending the second bottom dust flap 38 upwardly along the score line 44, inserting the supplemental reinforcing panel behind the front panel, and then allowing the second bottom dust flap to assume a vertical position wherein it is disposed normal to the front and rear panels.

First bottom dust flap 32 is now moved to a position of adjacency to second bottom dust flap 38 and bottom panel 34 is moved to a position of adjacency to first bottom dust flap 32.

Tuck flap 36 is inserted between front panel 18 and supplmental reinforcing panel 40 with the locking slot 48 between flap 36 and panel 21 being engaged with a locking shoulder 50 on first bottom dust flap 32.

Locking shoulder 50 is provided by cutting away one vertical edge of first bottom dust flap 32 for all but a small portion of its length.

Similar locking shoulders are provided on first and second top dust flaps 24 and 26 respectively for engagement in the locking slots 46 between top panel 28 and its tuck flap 30 when the top dust flaps and top panel are closed and tuck flap 30 is inserted between the front panel and supplemental reinforcing panel 40.

The presence of only a single lock on the bottom of the carton, i.e. the interlock of shoulder 50 in slot 48, is a serious disadvantage, there being no lock at all adjacent one edge of the bottom panel, wherefore the bottom panel and dust flaps can easily become disengaged.

This deficiency is corrected in the blank and carton of the invention as shown in FIGS. 2–7.

Figure 2:
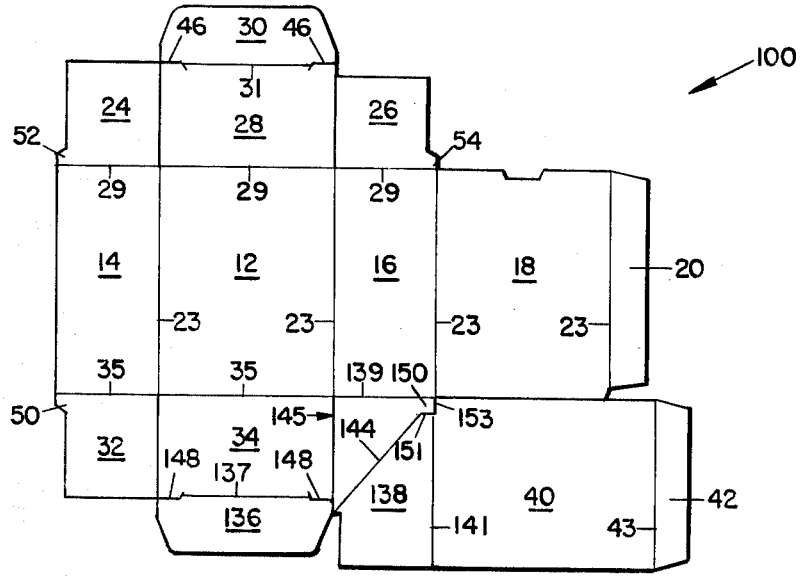
FIG. 2 is a top plan view of a blank for forming a carton of the invention.
Figure 3:
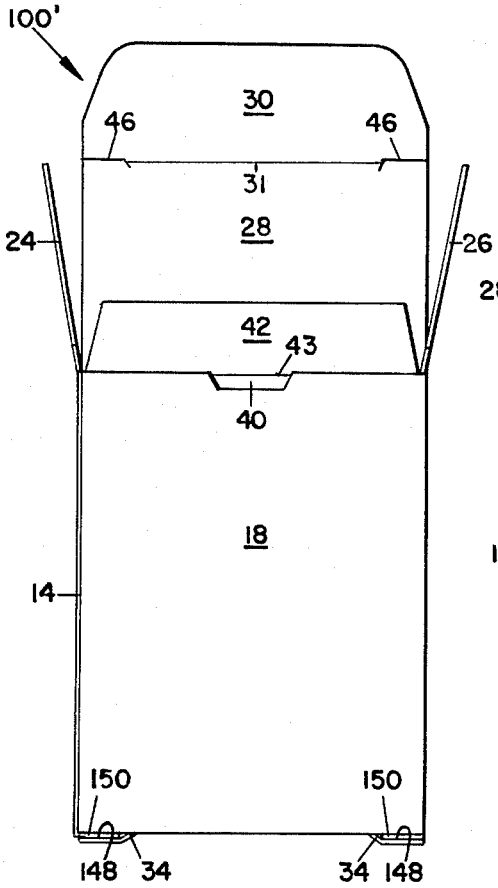
FIG. 3 is a front elevational view of a carton erected from the blank of FIG. 2.
Figure 4:
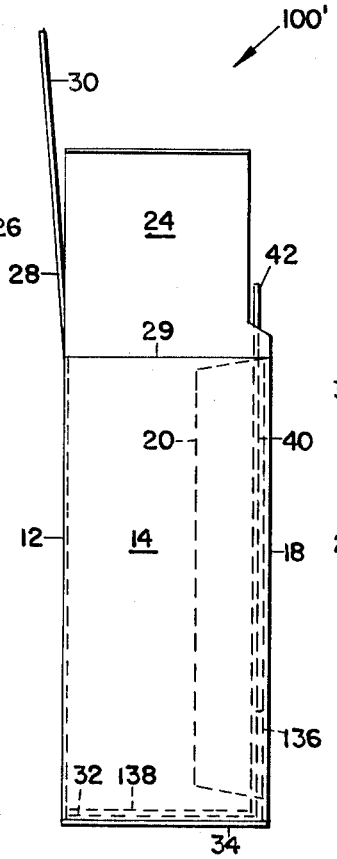
FIG. 4 is a side elevational view of the carton of FIG. 3.
Figure 5:
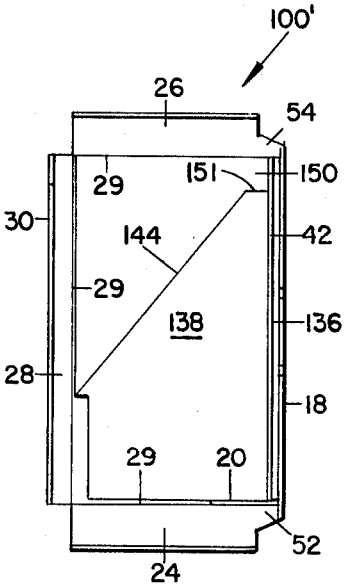
FIG. 5 is a top plan view of the carton of FIG. 3.
Figure 6:
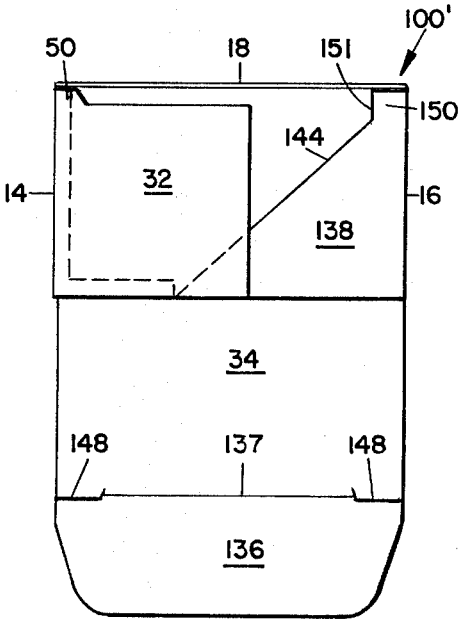
FIG. 6 is a bottom plan view of the carton of FIG. 3 with the bottom panel and tuck flap in an opened position.
Figure 7:
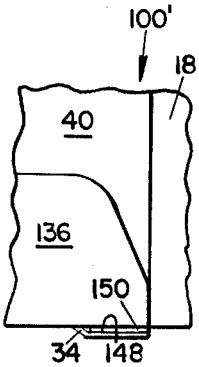
FIG. 7 is an enlarged, fragmentary front elevational view showing the bottom panel corner interlock, with the front panel being shown in an opened position for clarity.

The carton blank of the invention is designated by 100 in FIG. 2 and is identical to the carton blank 10 of FIG. 1 with the exception of differences in the bottom panel tuck flap and the second bottom dust flap. Accordingly, only those components will be described and given new reference numbers herefollowing.

Carton blank 100 forms the carton 100' of FIGS. 3 – 7.

In blank 100, a tuck flap 136 is hinged to the lower edge of bottom panel 34 along a horizontal, transversely-extending score line 137.

A second bottom dust flap 138 is hinged to the lower end of second side panel 16 along a horizontal, transversely-extending score line 139 which is aligned with the score lines 35.

Supplemental reinforcing panel 40 is hinged at one of its edges to a side edge of second bottom dust flap 138 along a vertical, longitudinally-extending score line 141 which is offset by approximately 1/32 inch from the score line 23 separating front panel 18 and second side panel 16.

A score line 144 is provided in second bottom dust flap 138 and extends diagonally from adjacent score line 139 to a vertical edge 145 of the second bottom dust flap disposed adjacent bottom panel 34 and tuck flap 136.

A pair of spaced, horizontal locking slots 148, 148 are provided at the opposite ends of the score line 137 which separates tuck flap 136 and bottom panel 34, the locking slots 148 being disposed approximately 1/32 inch downwardly from score line 137.

A horizontal slit or cut 151 is provided in second bottom dust flap 138 immediately below score line 139, the slit or cut terminating at one of its ends at the upper end of diagonal score line 144 and at its opposite end at score line 141. A vertical slit or cut 153 is made in the upper end of score line 141 and extends downwardly from score line 139 to horizontal slit or cut 151.

The slits or cuts 151 and 153 together form a locking shoulder 150 which is engageable in one of the locking slots 148 between the bottom panel 34 and its tuck flap 136 on carton erection.

The other slot 148 receives the shoulder 50 of first bottom dust flap 32 therein on carton erection as with the FIG. 1 embodiment.

By the expedient of supplying a locking shoulder on the second bottom dust flap 138, a carton is provided which has a double lock on the bottom panel, a feature not found in the prior art blank and carton.

With the blank of FIG. 2, after erection of the second and first bottom dust flaps 138 and 32 respectively, tuck flap 136 is inserted between front panel 18 and supplemental reinforcing panel 40, with the locking slots 148 being engaged with the locking shoulders 50 and 150 on first and second bottom dust flaps 32 and 138 respectively.

I claim:

1. In a carton of the type comprising spaced front, rear and side panels, wherein a supplemental reinforcing panel is disposed within the carton immediately rearwardly of the front panel, with the supplemental reinforcing panel being hingedly connected to a first bottom dust flap which is hinged to one of the side panels, and a second bottom dust flap is hinged to the other of the side panels, and a bottom panel is hinged to the rear panel, the improvement which comprises, locking shoulders on the bottom dust panels and locking slots on the bottom panel, the locking shoulders being engageable with the locking slots for providing a double interlock on carton erection.

2. A carton according to claim 1, wherein the locking tongue on one bottom dust panel is defined by a pair of right-angularly disposed slits in the panel.

* * * * *